United States Patent [19]

Ren

[11] 4,124,830

[45] Nov. 7, 1978

[54] WAVEGUIDE FILTER EMPLOYING DIELECTRIC RESONATORS

[75] Inventor: Chung-Li Ren, Andover, Mass.

[73] Assignee: Bell Telephone Laboratories, Incorporated, Murray Hill, N.J.

[21] Appl. No.: 837,033

[22] Filed: Sep. 27, 1977

[51] Int. Cl.[2] ..... H01P 1/20; H01P 7/06; H01P 1/00

[52] U.S. Cl. ..... 333/73 W; 333/83 R; 333/98 R

[58] Field of Search ..... 333/73 R, 73 C, 73 S, 333/73 W, 83 R, 98 R

[56] References Cited

U.S. PATENT DOCUMENTS

| | | | |
|---|---|---|---|
| 2,588,226 | 3/1952 | Fox | 333/73 W |
| 3,237,132 | 2/1966 | Okaya | 333/73 |
| 3,548,348 | 12/1970 | Gerdine | 333/98 |
| 3,579,153 | 5/1971 | Wang | 333/73 |
| 3,821,669 | 6/1974 | Wuerffel | 333/83 R |
| 3,840,828 | 10/1974 | Linn et al. | 333/73 S |
| 3,938,064 | 2/1976 | O'Bryan, Jr. et al. | 333/73 S |
| 3,973,226 | 8/1976 | Affolter et al. | 333/73 W |
| 4,028,652 | 6/1977 | Wakino et al. | 333/73 W |

*Primary Examiner*—Alfred E. Smith
*Assistant Examiner*—Harry E. Barlow
*Attorney, Agent, or Firm*—Stephen M. Gurey

[57] ABSTRACT

A waveguide bandstop filter is described. Two ceramic dielectric disc resonators each having a resonant frequency $f_0$ and separated by $\frac{3}{4}\lambda go$, where $\lambda go$ is the wavelength at $f_0$, are each disposed in individual apertures in the waveguide wall. The substantial portion of each resonator is exterior to the waveguide cavity and surrounded by a metallic housing which isolates each resonator from each other. The resonators are oriented so that a coupling arrangement exists between the electromagnetic energy propagating through the waveguide and each resonator so that a resonant mode is excited therein at frequency $f_0$.

21 Claims, 5 Drawing Figures

WAVEGUIDE FILTER EMPLOYING DIELECTRIC RESONATORS

BACKGROUND OF THE INVENTION

This invention relates to microwave filters and, in particular, to waveguide filters employing dielectric resonators.

Prior art waveguide filters have utilized dielectric resonators by placing them inside the waveguide. Such a structural configuration has several design problems. For example, the compensation necessary to correct for the perturbation caused by a dielectric resonator within a waveguide is too large and thus results in a poor frequency match in the waveguide passband. In addition, since a frequency tuning device is generally required in a practical filter design, the addition of such a device within a waveguide causes additional perturbation to the passband performance. Also, when plural dielectric resonators are placed in the propagating waveguide exposed to each other, inter-resonator coupling results in a reduction in peak insertion loss. Since sufficient isolation between resonators cannot be achieved when plural dielectrics are exposed to each other in the waveguide, maximum peak insertion loss cannot be realized.

SUMMARY OF THE INVENTION

An object of the present invention is to provide a practical design for a waveguide filter utilizing dielectric resonators.

In accordance with the present invention, a dielectric resonator having a predetermined resonant frequency is mounted within a housing and through an aperture in the waveguide wall so that a coupling arrangement exists between the magnetic fields within the waveguide and the resonator. This coupling arrangement causes the resonator to excite a resonant mode and results in band rejection in the propagating waveguide at the resonant frequency. In the particular embodiment of the present invention described herein, two dielectric ceramic resonators having the shape of a cylindrical disc and having the same resonant frequency are coupled to the waveguide. By separating the resonators by $\frac{3}{4}\lambda go$, where $\lambda go$ is the wavelength at the resonant frequency, the maximum insertion loss in the propagating waveguide at the resonant frequency is obtained.

It is a feature of the present invention that inter-resonator coupling is minimized by isolating each resonator in its own housing exterior to the waveguide cavity.

DETAILED DESCRIPTION

Figure 1:
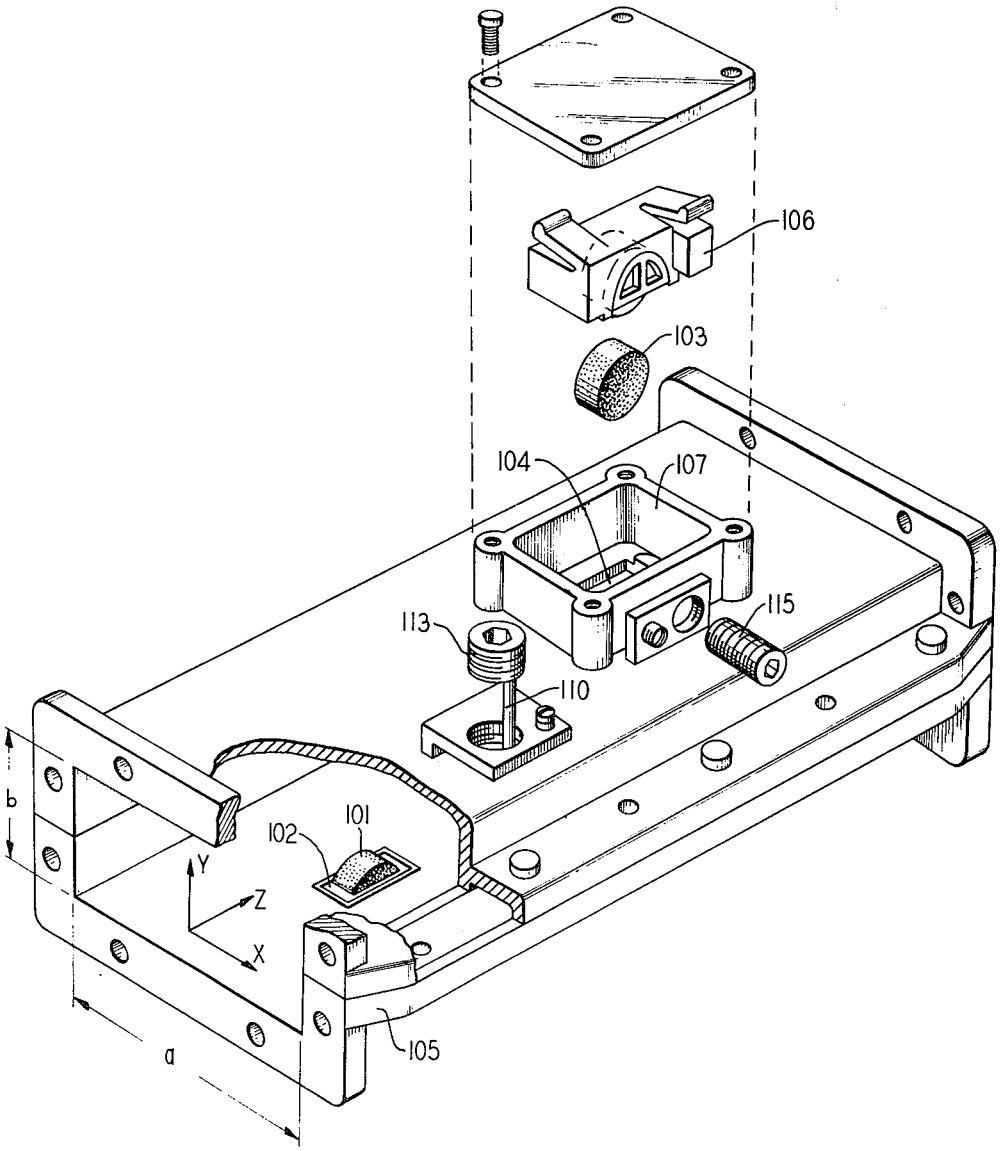
FIGS. 1, 2 and 3 show three views of a bandstop waveguide filter employing the principles of the present invention.
Figure 2:
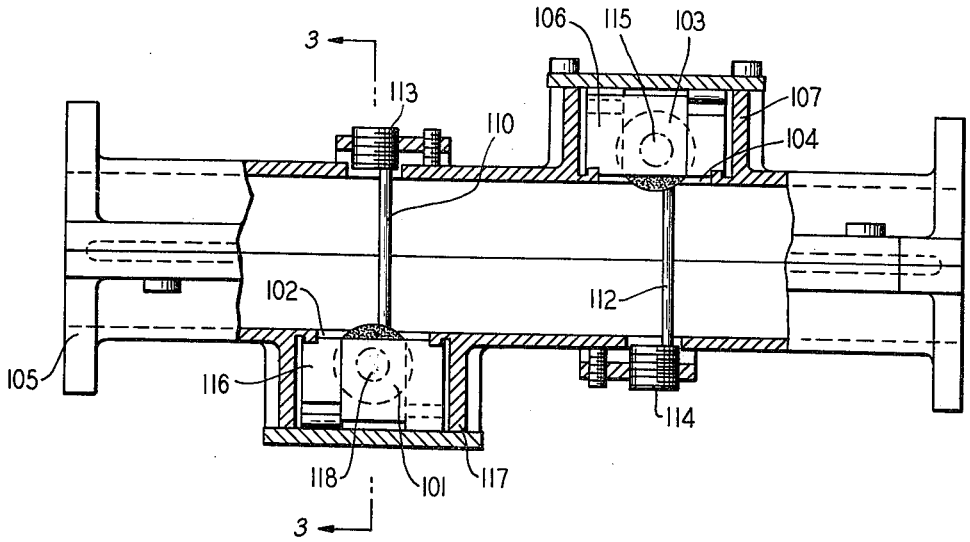
Figure 3:
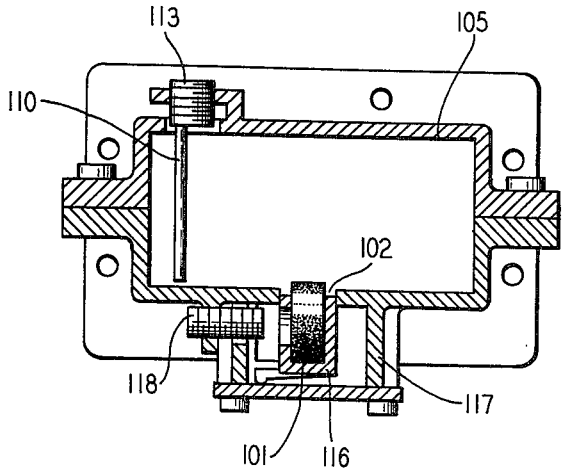

Three views of a ceramic resonator waveguide bandstop filter employing the principles of the present invention are shown in FIGS. 1, 2 and 3. With reference to FIGS. 1, 2 and 3, a circular disc ceramic dielectric resonator 101 having a predetermined resonant frequency $f_0$ is disposed in the lower wall of waveguide 105 through aperture 102 so that a small portion of the resonator extends into the waveguide cavity. The remaining substantial portion of resonator 101 is held by a mounting fixture 116 within metallic housing 117 exterior to the waveguide. A similar circular disc ceramic dielectric resonator 103 having resonant frequency $f_0$ is disposed in the upper waveguide wall through aperture 104 and held by mounting fixture 106 in housing 107. For purposes of illustration in FIG. 1, however, resonator 103 and holder 106 are removed from housing 107 to show the mechanical interlock between components. Although resonators 101 and 103 are shown mounted in opposite waveguide walls, they both may be mounted in either the upper or lower wall of the waveguide.

In accordance with the present invention, when an electromagnetic wave is transmitted between the input and output ports of the filter, a coupling arrangement exists between the transverse magnetic field $H_x$ of the dominant mode in the transmitted wave and resonators 101 and 103. Thus, the magnetic field $H_x$ at the waveguide walls is coupled to each resonator which induces a resonant mode therein at frequency $f_0$, the resonant frequency $f_0$ of each ceramic dielectric disc resonator being determined by the dielectric constant of the ceramic material, the diameter of the resonator disc and the length of the disc.

The resonant state of each resonator results in a measurable band rejection and insertion loss between the input and output ports at the frequency $f_0$. Maximum insertion loss reinforcement is obtained by separating the resonators by $\frac{3}{4}\lambda go$, where $\lambda go$ is the wavelength of $f_0$. Maximum filtering at frequency $f_0$ is thus obtained.

In order to prevent a degradation in filter performance which would result if spurious resonant modes were induced in the resonator in the filter passband, the length of the resonator discs are chosen to be less than the diameter of the disc so that the principal resonant mode induced is the lowest order circular electrical modex $H_{011}$. In addition, to limit the resonance to this desired circular mode to avoid spurious mode excitation, the planar surfaces of resonators 101 and 103 are disposed perpendicular to the $H_x$ field, and the center of each disc is positioned along the center line of the waveguide wall where the longitudinal magnetic field $H_z$ is zero.

Housings 107 and 117 essentially isolate resonators 101 and 103 from each other and thus minimize inter-resonator coupling. Since the induced current on the wall surfaces of the housing contribute to filter loss, the size of the housing is made as large as possible so long as no propagating waveguide modes are generated. Additional isolation between the housing and the main waveguide cavity is obtained by minimizing the dimensions of the aperture.

Mounting fixtures 106 and 116 are made from a dielectric material having a low dielectric constant. To minimize filter loss, the mounting fixture is designed with minimum use of mounting material. In addition, the use of mounting material near or at the electromagnetic field of coupling is avoided. Styrene-Phenylene-Oxide molding compound is the preferred material for use as the mounting fixture since its ability to be molded lowers production cost. An alternative material, such as fused quartz, has the cost disadvantage of requiring machine fabrication.

The coupling structure of the present invention has an asymmetrical frequency response which is corrected by disposing a tunable shunt inductive element in the waveguide cavity proximate to each resonator 101 and 103. In particular, a shunt inductive metal post 110 is disposed in the same phase plane as resonator 101 and a shunt inductive metal post 112 is disposed in the same phase plane as resonator 103. Shunt inductive posts 110 and 112 provide fixed inductances which are functions of the post diameters and their locations relative to the sidewalls of the waveguide. Tuning post 110 is perpendicularly mounted on adjustment screw 113 so that the axis of post 110 is non-coincident with the screw axis. Tuning is accomplished by turning screw 113 to vary the location of post 110 within the waveguide. Similarly, the position of post 112 is varied by turning an adjustment screw 114 for a symmetrical band reject response of resonator 103.

As aforenoted, the resonant frequency $f_0$ of dielectric resonators 101 and 103 is a function of the dielectric constant of the ceramic material and the physical dimensions of the disc. Although these parameters could be manufactured within a tight tolerance to meet design specifications so that frequency tuning would be unnecessary, such a manufacturing process would be economically impractical. Accordingly, a tuning screw 115 is disposed in metallic housing 107 such that the axis of the screw is perpendicular to the planar surface of resonator 103. The resonant frequency of resonator 103 is varied by adjusting the position of screw 115 within metallic housing 107. In addition, by aligning the screw axis with the axis of resonator disc 103, the excitation of spurious resonant modes in the dielectric resonator within the operating band can be avoided. Maximum tuning range is obtained by using a screw having a diameter as large as possible. A screw 118 is similarly disposed in housing 117 to tune the resonant frequency of resonator 101.

Figure 4:
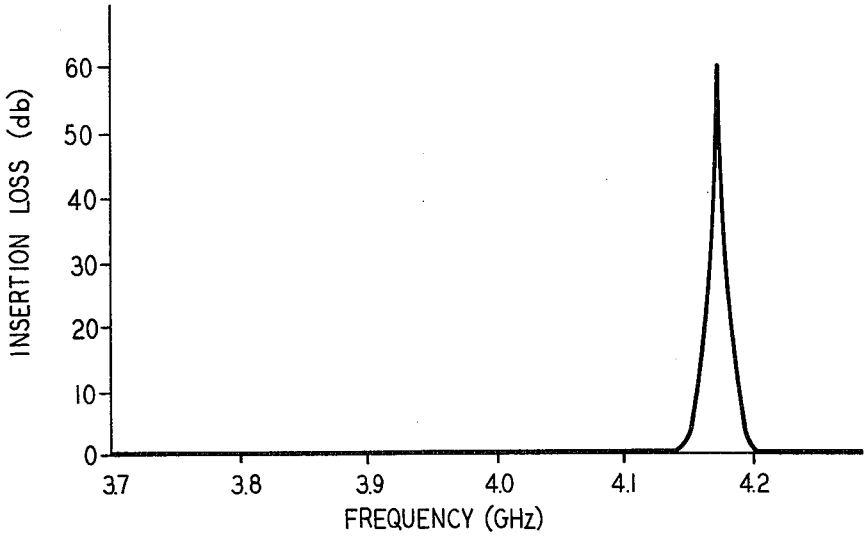
FIG. 4 shows the insertion loss obtained for a particular design example of such a bandstop filter.

A design example of a bandstop filter is presented hereinbelow. A waveguide having a waveguide width of 2.290 inches and waveguide height of 1.145 inches transmits a signal in the frequency range of 3.7 to 4.2 GHz. A stopband at 4.175 GHz is achieved by disposing a $Ba_2TI_9O_{20}$ ceramic disc resonator in a housing having an interior width of 0.800 inches, interior length of 1.100 inches and an interior height of 0.550 inches. The ceramic resonator has a diameter of 0.575 inches and length of 0.15 inches and has a relative dielectric constant of 39.8. A frequency tuning range of 35 MHz is obtained by using a 0.375 inch diameter screw as tuning screws 115 and 118. The wavelength $\lambda go$ of the resonant frequency 4.175 GHz is 3.59 inches. The resonators are therefore separated by 2.69 inches. FIG. 4 shows the measured insertion loss of this filter.

It should be readily appreciated by one skilled in the art that a filter employing the principles of the present invention can be designed using only one resonator coupled to the waveguide in the manner described hereinabove. In such an embodiment, the peak insertion loss at the resonant frequency would be approximately half the insertion loss obtained using two resonators as in the aforedescribed embodiment. More than two resonators can be used to obtain greater insertion loss at the resonant frequency.

The structural configuration of the present invention shown in FIGS. 1, 2 and 3 can be readily adapted as a bandpass filter with two tone-rejection bands. In particular, the filter can be designed to pass a signal band centered at $f_0$ while rejecting tones at $\pm\Delta f$ away from $f_0$. In particular, the two stop bands are provided by two dielectric resonators coupled to the waveguide, one having a resonant frequency of $f_0-\Delta f$ and the other having a resonant frequency of $f_0+\Delta f$. The resonators are spaced $\lambda go/2$, where $\lambda go$ is the wavelength at $f_0$ such that at $f_0$, the off-resonance circuit elements of the two resonators form a bandpass cavity.

Figure 5:
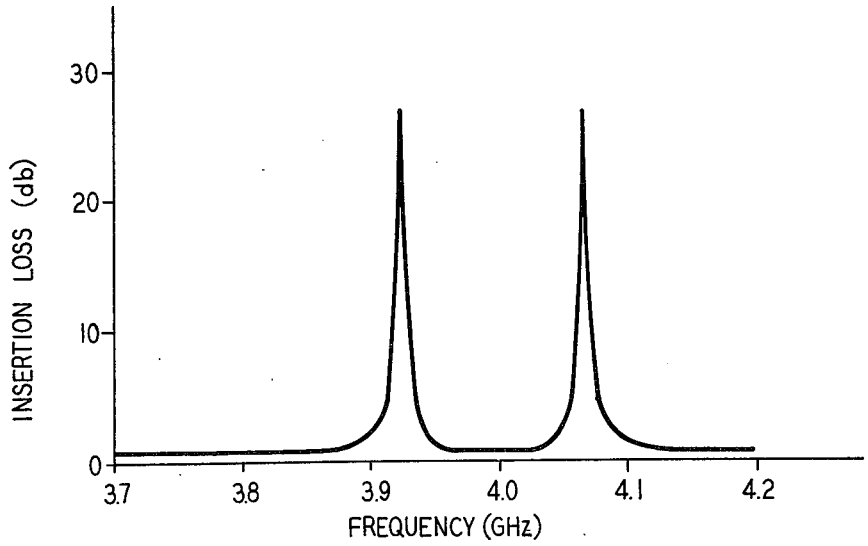
FIG. 5 shows the insertion loss obtained for a particular design example of a bandpass filter using the same coupling principles of the present invention.

FIG. 5 shows the measured insertion loss for a bandpass filter designed to pass a signal band centered at 4 GHz and reject tones at 3.93 GHz and 4.07 GHz. This filter is realized by separating by 1.93 inches a first $Ba_2Ti_9O_{20}$ resonator having a 0.575 inch diameter and 0.180 inch length and a second $Ba_2Ti_9O_{20}$ resonator having a 0.575 inch diameter and 0.160 inch length.

Various modifications of this invention can be made without departing from the spirit and scope of the invention. For example, although the preferred embodiments of the present invention described hereinabove achieved dielectric resonance by coupling to the transverse magnetic field of the dominant mode in the waveguide $H_x$, resonance can also be achieved by orienting the resonators so that coupling exists between the resonator and longitudinal magnetic field of the dominant mode in the waveguide, Hz. In this embodiment a disc resonator is disposed in the narrow waveguide wall and oriented so that the planar surfaces of the disc are perpendicular to the Hz magnetic component. This configuration is asymmetrical in the propagating waveguide about the plane of symmetry bisecting the broad side of the waveguide wall and the $H_{20}$ mode is the major evanescent mode excited. The structure in FIGS. 1, 2 and 3 with $H_x$ coupling is symmetric and the major evanescent mode excited is the $H_{30}$ mode which is further below cutoff than the $H_{20}$ mode and therefore contributes to a lower level of inter-resonator coupling. Therefore, $H_x$ coupling is the preferred coupling arrangement.

The above-described arrangement is illustrative of the application and principles of the invention. Other embodiments may be devised by those skilled in the art without departing from the spirit and scope of the invention.

What is claimed is:

1. A waveguide filter comprising a conductively bounded waveguide having a waveguide wall and capable of propagating electromagnetic energy therethrough, an aperture being located in said waveguide wall, a dielectric resonator having a predetermined resonant frequency adaptively mounted in said aperture so that a substantial portion of said resonator is exterior to said waveguide and the remainder of said resonator is within said waveguide.

2. A waveguide filter in accordance with claim 1 further comprising a housing element surrounding said substantial portion of said dielectric resonator.

3. A waveguide filter in accordance with claim 2 wherein said dielectric resonator has the shape of a cylindrical disc.

4. A waveguide filter in accordance with claim 3 wherein said dielectric resonator is ceramic.

5. A waveguide filter in accordance with claim 4 wherein said ceramic is $Ba_2Ti_9O_{20}$.

6. A waveguide filter in accordance with claim 3 wherein said housing includes a frequency tuning means for tuning the resonant frequency of said dielectric resonator.

7. A waveguide filter in accordance with claim 6 wherein said filter further comprises a tunable shunt inductive means within said waveguide to compensate for the asymmetry of the band reject response of said resonator.

8. A waveguide bandstop filter comprising a rectangular waveguide having two broad width and two narrow width planar waveguide walls and capable of propagating electromagnetic energy therethrough, a plurality of apertures being located in said waveguide walls, a plurality of dielectric resonators each having a resonant frequency $f_0$, each one of said resonators being adaptively mounted in one of said apertures so that a substantial portion of each one of said resonators is exterior to said waveguide and the remainder of each one of said resonators is within said waveguide, said resonators being separated by $\frac{3}{4}\lambda go$, where $\lambda go$ is the wavelength at $f_0$.

9. A waveguide bandstop filter in accordance with claim 8 further comprising a plurality of housing means, one each of said plurality of housing means surrounding said substantial portion of each one of said dielectric resonators.

10. A waveguide bandstop filter in accordance with claim 9 wherein each one of said dielectric resonators has the shape of a cylindrical disc.

11. A waveguide bandstop filter in accordance with claim 10 wherein each of said resonators is disposed along the center line of the broad width walls of said waveguide and the planar surfaces of said disc resonators are parallel to the narrow width walls of said waveguide.

12. A waveguide bandstop filter in accordance with claim 10 wherein each of said dielectric resonators is ceramic.

13. A waveguide bandstop filter in accordance with claim 12 wherein said ceramic is $Ba_2Ti_9O_{20}$.

14. A waveguide bandstop filter in accordance with claim 10 further comprising supporting means having a low dielectric constant for supporting said dielectric resonator within said housing.

15. A waveguide bandstop filter in accordance with claim 14 wherein said supporting means is composed of Styrene-Phenylene-Oxide molding compound.

16. A waveguide bandstop filter in accordance with claim 10 further comprising frequency tuning means in each of said housing means for tuning the resonant frequency of each of said dielectric resonators.

17. A waveguide bandstop filter in accordance with claim 16 further comprising a plurality of tunable shunt inductive means within said waveguide to compensate for the asymmetry of the band reject response of each of said resonators.

18. A waveguide bandpass filter for passing a signal centered at a frequency $f_0$ and rejecting signals at a frequency $\pm\Delta f$ from $f_0$ comprising a rectangular waveguide having two broad width and two narrow width planar conductive waveguide walls and capable of propagating electromagnetic energy therethrough, two apertures being located in said waveguide walls, a first dielectric resonator having a resonant frequency $f_0-\Delta f$ and a second dielectric resonator having a resonant frequency $f_0+\Delta f$, each one of said resonators being adaptively mounted in one of said apertures so that the substantial part of each one of said resonators is exterior to said waveguide and the remainder of each one of said resonators is within said waveguide, said resonators being separated by $\lambda go/2$, where $\lambda go$ is the wavelength at $f_0$.

19. A waveguide bandpass filter in accordance with claim 18 further comprising housing means surrounding each of said dielectric resonators.

20. A waveguide bandpass filter in accordance with claim 19 wherein each of said dielectric resonators is a $Ba_2Ti_9O_{20}$ ceramic material and is disposed along the center line of either broad width wall of said waveguide, the planar surfaces of each of said discs being parallel to the narrow width walls of said waveguide.

21. A waveguide bandpass filter in accordance with claim 20 further comprising frequency tuning means in each of said housing means for tuning the resonant frequency of each of said dielectric resonators, and two tunable shunt inductive means within said waveguide to compensate for the asymmetry of the band reject response of each of said resonators.

* * * * *